US007959262B2

(12) United States Patent
Omata et al.

(10) Patent No.: US 7,959,262 B2
(45) Date of Patent: Jun. 14, 2011

(54) INK JET RECORDING HEAD SUBSTRATE, AND INK JET RECORDING HEAD INCLUDING THE SUBSTRATE

(75) Inventors: Koichi Omata, Kawasaki (JP); Yoshiyuki Imanaka, Kawasaki (JP); Souta Takeuchi, Yokohama (JP); Takaaki Yamaguchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 12/470,120

(22) Filed: May 21, 2009

(65) Prior Publication Data

US 2009/0289995 A1 Nov. 26, 2009

(30) Foreign Application Priority Data

May 26, 2008 (JP) ..... 2008-136495

(51) Int. Cl.
*B41J 2/14* (2006.01)
*B41J 2/16* (2006.01)

(52) U.S. Cl. ..... 347/50; 347/58

(58) Field of Classification Search ..... 347/40, 347/42, 44, 49–50, 57–59, 61, 62, 65, 71
See application file for complete search history.

(56) References Cited

U.S. PATENT DOCUMENTS 6,527,367 B2 * 3/2003 Yabe ..... 347/43
7,216,961 B2 5/2007 Oikawa et al.
7,284,841 B2 * 10/2007 Imai et al. ..... 347/71

* cited by examiner

*Primary Examiner* — Thinh H Nguyen
(74) *Attorney, Agent, or Firm* — Fitzpatrick, Cella, Harper & Scinto

(57) ABSTRACT

An ink jet recording head substrate is provided with: an array of a plurality of energy generating bodies for generating energy utilized to discharge ink; and an ink supply port arranged along the array to supply ink to the plurality of energy generating bodies, the array and the ink supply port each extending in a longitudinal direction of the ink jet recording head substrate, the ink jet recording head substrate comprising: a first terminal electrically connected with the plurality of energy generating bodies, the first terminal being arranged along beside a first side of the ink jet recording head substrate, the first side extending in a cross direction intersecting the longitudinal direction; and a second terminal electrically connected with the plurality of energy generating bodies, the second terminal being arranged beside a second side of the ink jet recording head substrate, the second side extending in the longitudinal direction, so as to be arranged in an area between the first side and a phantom line that passes through a longitudinal end of the ink supply port closer to the first side and extends in the cross direction.

5 Claims, 9 Drawing Sheets

INK JET RECORDING HEAD SUBSTRATE, AND INK JET RECORDING HEAD INCLUDING THE SUBSTRATE

BACKGROUND OF THE INVENTION

1. Field of the Invention

The present invention relates to an ink jet recording head substrate, and an ink jet recording head including the substrate.

2. Description of the Related Art

Typically, electrothermal conversion elements (heaters) of a recording head installed in an ink jet recording apparatus and a driving circuit and wiring for the heaters are formed on a same substrate using a semiconductor process technology, as disclosed in U.S. Pat. No. 7,216,960 (corresponding to Japanese Patent Application Laid-Open No. 2005-138428).

FIGS. 8 and 9 are schematic views illustrating an ink jet recording head substrate according to prior art.

FIGS. 8 and 9 illustrate the same substrate. FIG. 9 mainly illustrates heater driving power source wiring and ground wiring, and FIG. 8 mainly illustrates heater drivers and logic wiring underneath the heater driving power source wiring and ground wiring.

FIG. 8 is described first. An ink supply port 106 is provided at a center of the substrate, and a heater array 107 is arranged on both sides of the ink supply port 106. A driver array 501 for driving heaters is disposed behind the heater array 107, and logic wiring and logic circuit 502 are disposed behind the driver array 501. A plurality of connection pads 505 is arranged beside an edge of a shorter side of the substrate. Components such as a shift register 503, a decoder 504, and a temperature sensor (not illustrated) are provided between the ink supply port 106 and the plurality of connection pads 505.

In FIG. 9, heater driving power source wiring 603 is provided on the heater driver array, and ground wiring 604 is provided on the logic unit. The heater driving power source wiring 603 and the ground wiring 604 are connected to the outside via a heater driving connection pad 601 and a ground connection pad 602, respectively.

The power source wiring is divided in units of heater driving blocks, in order to ensure an approximately same wiring resistance for each arranged heater. Each wire has a different width depending on a distance from the connection pad so as to have a uniform resistance. Since the number of heaters simultaneously driven is 1 in any driving block, a voltage drop due to a wiring resistance is uniform in any heater.

In the case where the power source connection pads are provided only on one side of the substrate, the wire width increases excessively when the wiring is performed up to an opposite side of the substrate in the above-mentioned manner. Accordingly, the power source wiring on the substrate shows a symmetry between the upper and lower halves, as illustrated in FIG. 9. This requires a heater driving power source terminal and a ground terminal to be provided beside an edge of each of the two shorter sides of the substrate.

Pads other than the connection pads 601 and 602 of a power source system are used for a heater driving heat enable terminal, a data input terminal, a latch, a clock, a logic power source, a temperature sensor terminal, a rank measurement terminal, and so on.

In recent years, there is a demand for significant improvements in recording resolution and recording speed of an ink jet recording apparatus. This creates the need for an ink jet recording head substrate that is capable of high-density placement of heaters and logics and also has a greater length to increase the number of heaters itself. At the same time, enhanced functionality of the substrate itself is also desired, so that the inclusion of a fuse circuit, the provision of a plurality of temperature sensors for finer temperature control, and the like are necessary.

To realize the above-mentioned structure, the number of connection pads to the outside needs to be increased. In detail, as the number of necessary heaters increases, the logic circuit increases, which leads to an increase in the number of connection pads to outside the substrate. In addition, to achieve the above-mentioned functionality enhancement, pads for fuse reading/writing and output pads of temperature sensors need to be added.

This causes a problem that pads cannot be contained in a connection pad area at the substrate end. The pad area insufficiency tends to be significant particularly in a substrate for black ink which has one row of ink supply port and also has a large number of nozzles, due to a small width of the substrate.

When the substrate size on the shorter side where pads are arranged is increased as shown in FIG. 10, necessary pads can be contained. However, this causes a larger substrate size, and an increase in cost.

On the other hand, when necessary connection pads 701 are arranged on a longer side of the substrate as shown in FIG. 11, spaces 702 on the longer side other than the pads are wasted, causing a larger substrate size. This is because a logic circuit and wiring cannot be positioned under connection pads, and so the conventional substrate needs to be widened to use portions under which nothing is provided, as pads. Besides, the presence of connection pads on the longer side of the substrate is not preferable as it interferes with a wiping operation of wiping off ink adhering to a nozzle surface.

A method of reducing the pad size or arrangement pitch to enable more pads to be provided may also be contemplated. This method, however, tends to cause decreases in yield and implementation reliability as there is a high possibility of a short circuit occurring in wiring connections, and therefore has only a limited effect. Moreover, when the pad arrangement pitch is reduced, the width of power source wiring connected to the pad is reduced too, which induces a problem of a wiring resistance increase.

SUMMARY OF THE INVENTION

The present invention has an object of providing an ink jet recording head substrate that enables connection pads to be efficiently placed within a substrate of a limited size, and an ink jet recording head including the substrate.

To achieve the stated object, an ink jet recording head substrate according to the present invention is an ink jet recording head substrate provided with: an array of a plurality of energy generating bodies for generating energy utilized to discharge ink; and an ink supply port arranged along the array to supply ink to the plurality of energy generating bodies, the array and the ink supply port each extending in a longitudinal direction of the ink jet recording head substrate, the ink jet recording head substrate comprising: a first terminal electrically connected with the plurality of energy generating bodies, the first terminal being arranged along beside a first side of the ink jet recording head substrate, the first side extending in a cross direction intersecting the longitudinal direction; and a second terminal electrically connected with the plurality of energy generating bodies, the second terminal being arranged beside a second side of the ink jet recording head substrate, the second side extending in the longitudinal direction, so as to be arranged in an area between the first side and a phantom line that passes through a longitudinal end of the ink supply port closer to the first side and extends in the cross direction.

According to the present invention, it is possible to provide an ink jet recording head substrate that enables connection pads to be efficiently placed within a substrate of a limited size, and an ink jet recording head including the substrate.

Further features of the present invention will become apparent from the following description of exemplary embodiments with reference to the attached drawings.

DESCRIPTION OF THE EMBODIMENTS

The following describes an embodiment of the present invention with reference to drawings.

(Ink Jet Recording Apparatus)

Figure 1:
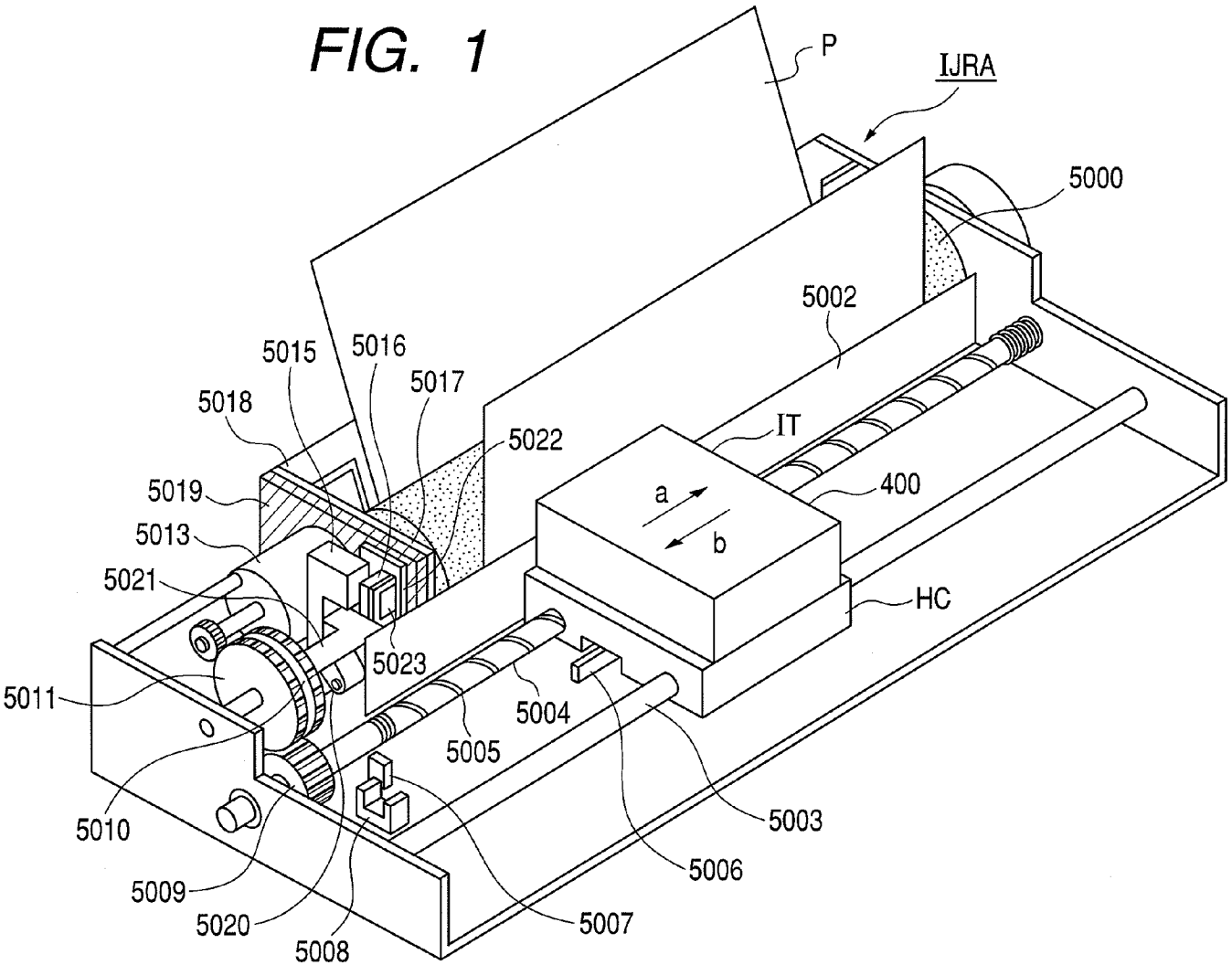
FIG. 1 is a schematic view of an ink jet recording apparatus to which the present invention is applicable.

First, an overview of an ink jet recording apparatus that uses an ink jet recording head including an ink jet recording head substrate according to the present invention is described below. FIG. 1 is a schematic view of an ink jet recording apparatus to which the present invention is applicable.

Referring to FIG. 1, a lead screw 5004 rotates via driving force transmission gears 5011 and 5009 in conjunction with forward and reverse rotation of a driving motor 5013. A carriage HC has a pin (not illustrated) engaging with a helical groove 5005 of the lead screw 5004, and is reciprocated in directions of arrows a and b according to the rotation of the lead screw 5004. An ink jet recording head 400 is mounted on the carriage HC.

A paper press plate 5002 presses a recording medium P against a platen 5000 along a movement direction of the carriage. Photosensors 5007 and 5008 are a home position detection unit for detecting the presence of a lever 5006 of the carriage in this area and switching a rotation direction of the motor 5013 and the like. A member 5016 supports a cap member 5022 that caps a front surface of the recording head. A suction unit 5015 sucks the inside of this cap to perform suction recovery of the recording head through an in-cap opening 5023. A cleaning blade 5017 and a member 5019 that enables the blade 5017 to move back and forth are supported by a main body support plate 5018. Note that the present invention is not limited to the blade 5017 in this embodiment, and a known cleaning blade is also applicable. A lever 5021 is used to start the suction for the suction recovery, and moves as a cam 5020 engaging with the carriage moves. A driving force from the driving motor is controlled by a known transmission unit such as clutch switching.

The operations of capping, cleaning, and suction recovery by these structures are carried out at corresponding positions of the cap member 5022 and the blade 5017 by action of the lead screw 5004 when the carriage HC is positioned in the home position area.

Figure 2:
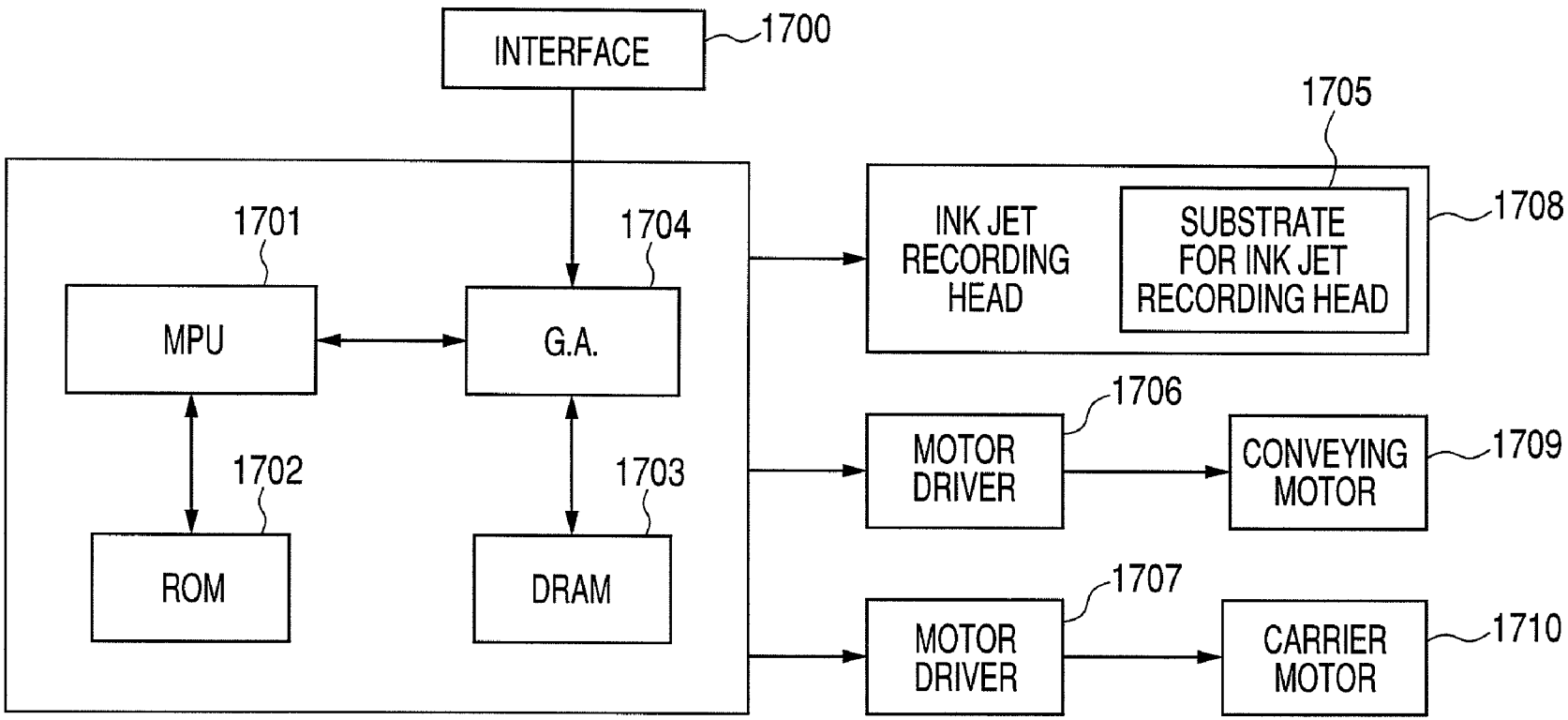
FIG. 2 is a block diagram illustrating a control structure for executing recording control of the ink jet recording apparatus.

Next, a control structure for executing recording control of the above-mentioned ink jet recording apparatus is described below, with reference to a block diagram illustrated in FIG. 2. In FIG. 2 illustrating a control circuit, an interface 1700 is used for inputting a recording signal. An MPU 1701 executes a control program. A program ROM 1702 stores the control program executed by the MPU 1701. A dynamic RAM (DRAM) 1703 stores various data (such as the above-mentioned recording signal and recording data supplied to the head). A gate array 1704 controls the supply of the recording data to a recording head 1708. A signal for driving the recording head is supplied through this gate array 1704. The gate array 1704 also controls data transfers between the interface 1700, the MPU 1701, and the RAM 1703.

Moreover, a carrier motor 1710 is used for conveying the recording head 1708. A conveying motor 1709 is used for conveying the recording paper. A substrate 1705 for an ink jet recording head is provided in the recording head 1708, and includes an ink discharge heater and a driving circuit for the ink discharge heater. Motor drivers 1706 and 1707 drive the conveying motor 1709 and the carrier motor 1710, respectively.

The following describes an operation of the above-mentioned control structure. When a recording signal is input in the interface 1700, the recording signal is converted to recording data for printing by the gate array 1704 and the MPU 1701. The motor drivers 1706 and 1707 are driven, and also the ink discharge heater is driven according to the recording data supplied to the ink jet recording head substrate 1705 in the recording head 1708, as a result of which a recording operation by the recording head 1708 is carried out.

(Ink Jet Recording Head Substrate and Ink Jet Recording Head)

The following describes an ink jet recording head substrate and an ink jet recording head according to the embodiment of the present invention, with reference to FIGS. 3 to 6.

Figure 3:
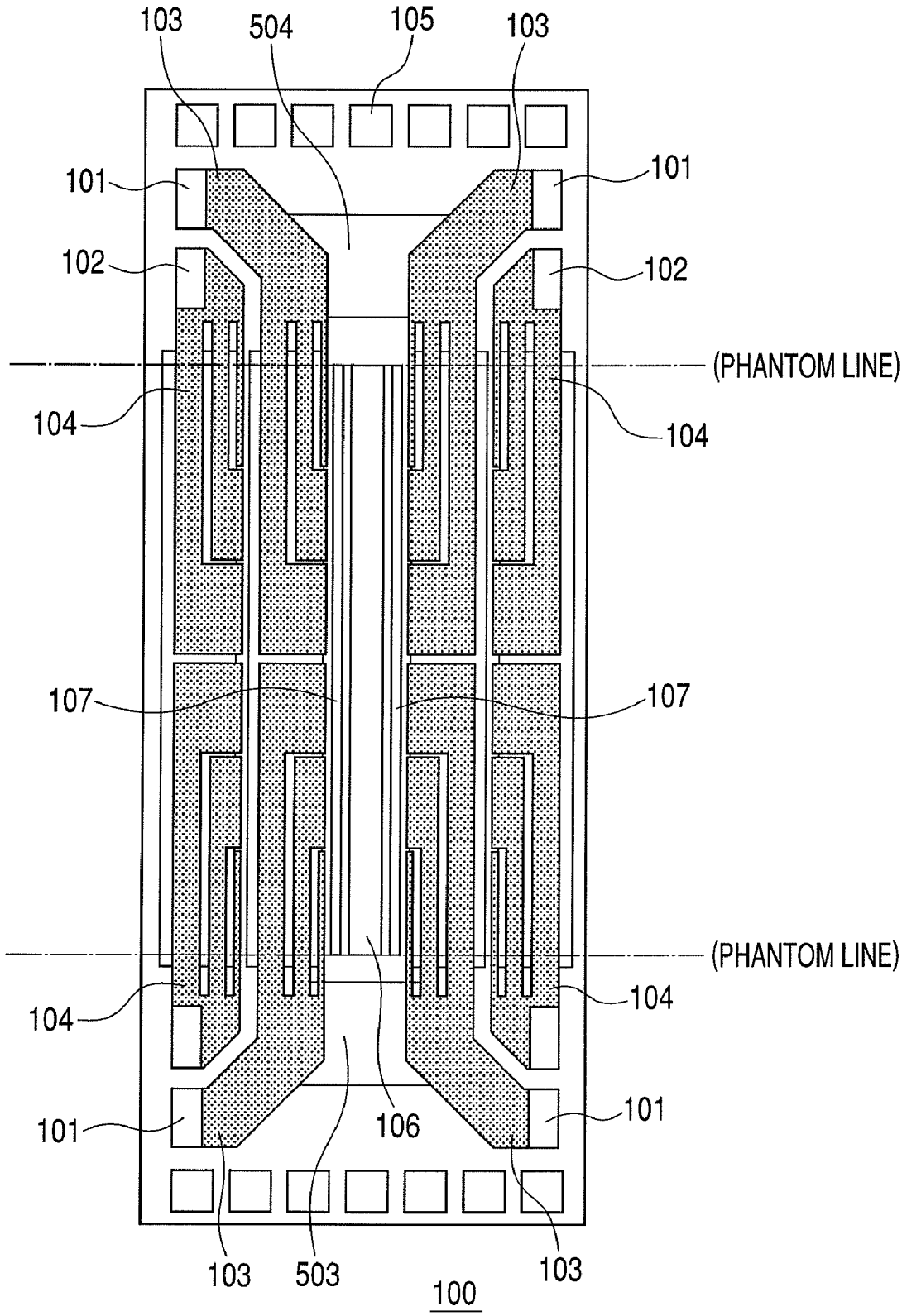
FIG. 3 is a schematic plan view mainly illustrating wiring of a power source system of an ink jet recording head substrate according to an embodiment of the present invention.

FIG. 3 is a schematic plan view mainly illustrating wiring of a power source system of an ink jet recording head substrate 100 in this embodiment. The substrate 100 in FIG. 3 has a rectangular shape. An ink supply port 106 extending in a longitudinal direction of the substrate is formed at a center of the substrate 100. A heater array 107 extending in a longitudinal direction of the ink supply port 106 is provided on both sides of the ink supply port 106. The heater array 107 is formed by arranging 256 heaters on one side at a pitch of 300 dpi (dot per inch), and there are a total of 512 heaters combining both sides. A heater is referred to here as a representative example of an energy generating body for generating energy that is used to discharge ink. Here, the heater is an electrothermal conversion element for generating thermal energy.

Heater driving power source wiring 103 for supplying driving power to the heaters is formed on a driver array (not illustrated) behind the heater array 107. Moreover, ground wiring 104 corresponding to the wiring 103 is formed on a logic circuit and logic wiring (not illustrated) behind the driver array.

Figure 9:
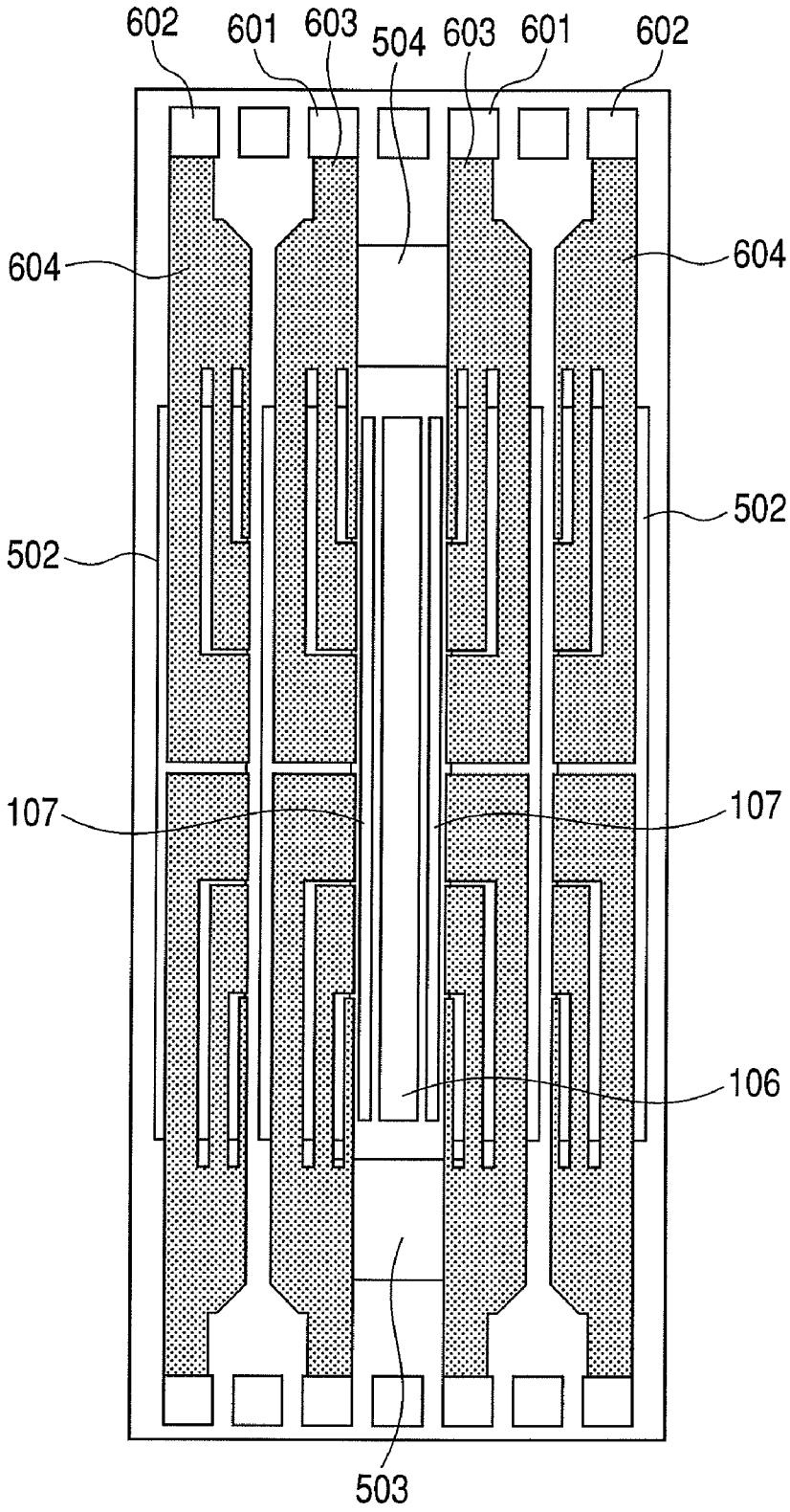
FIG. 9 is a schematic view illustrating the ink jet recording head substrate in FIG. 8.
Figure 10:
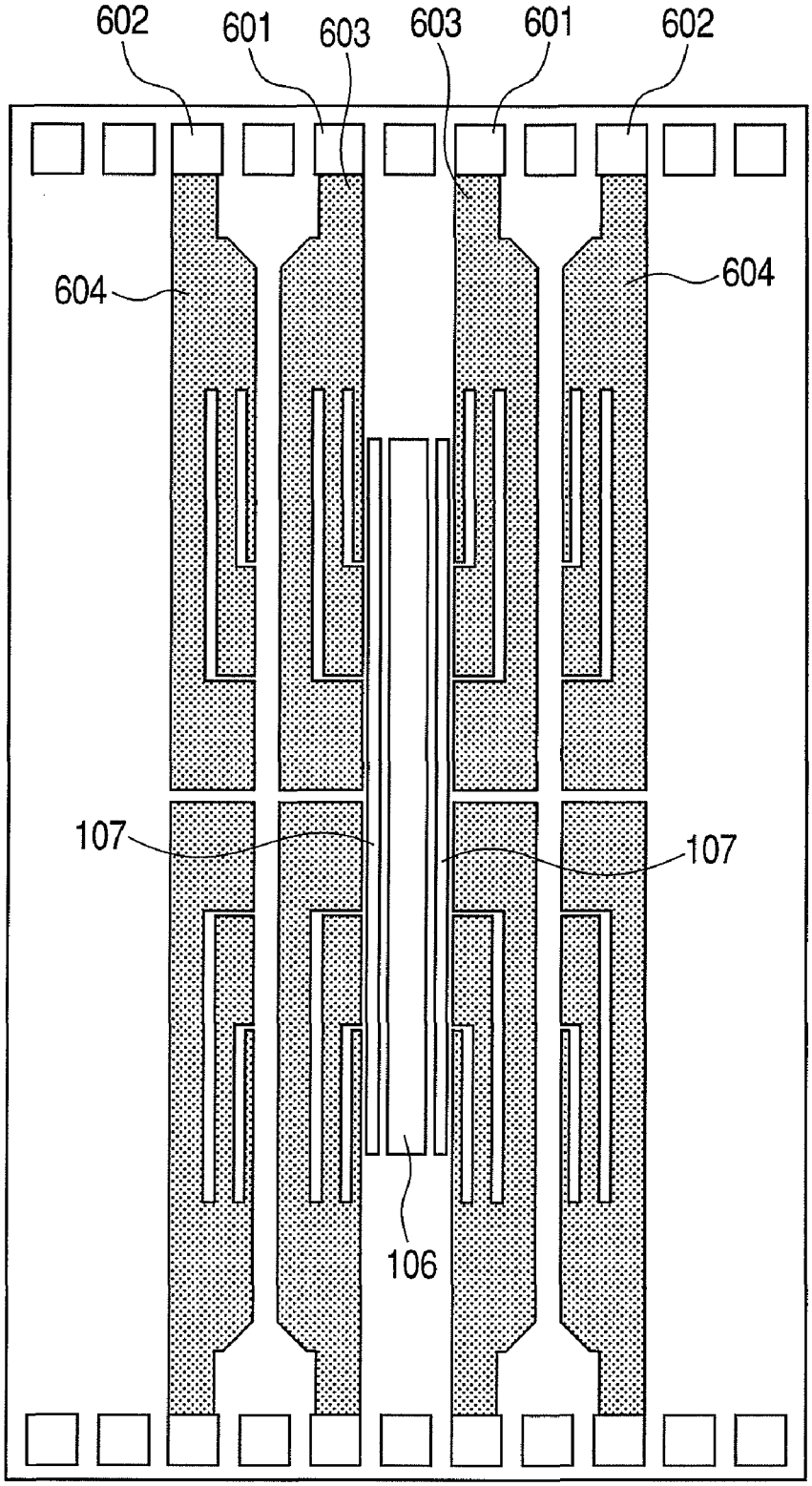
FIG. 10 is a schematic view illustrating another conventional ink jet recording head substrate.
Figure 11:
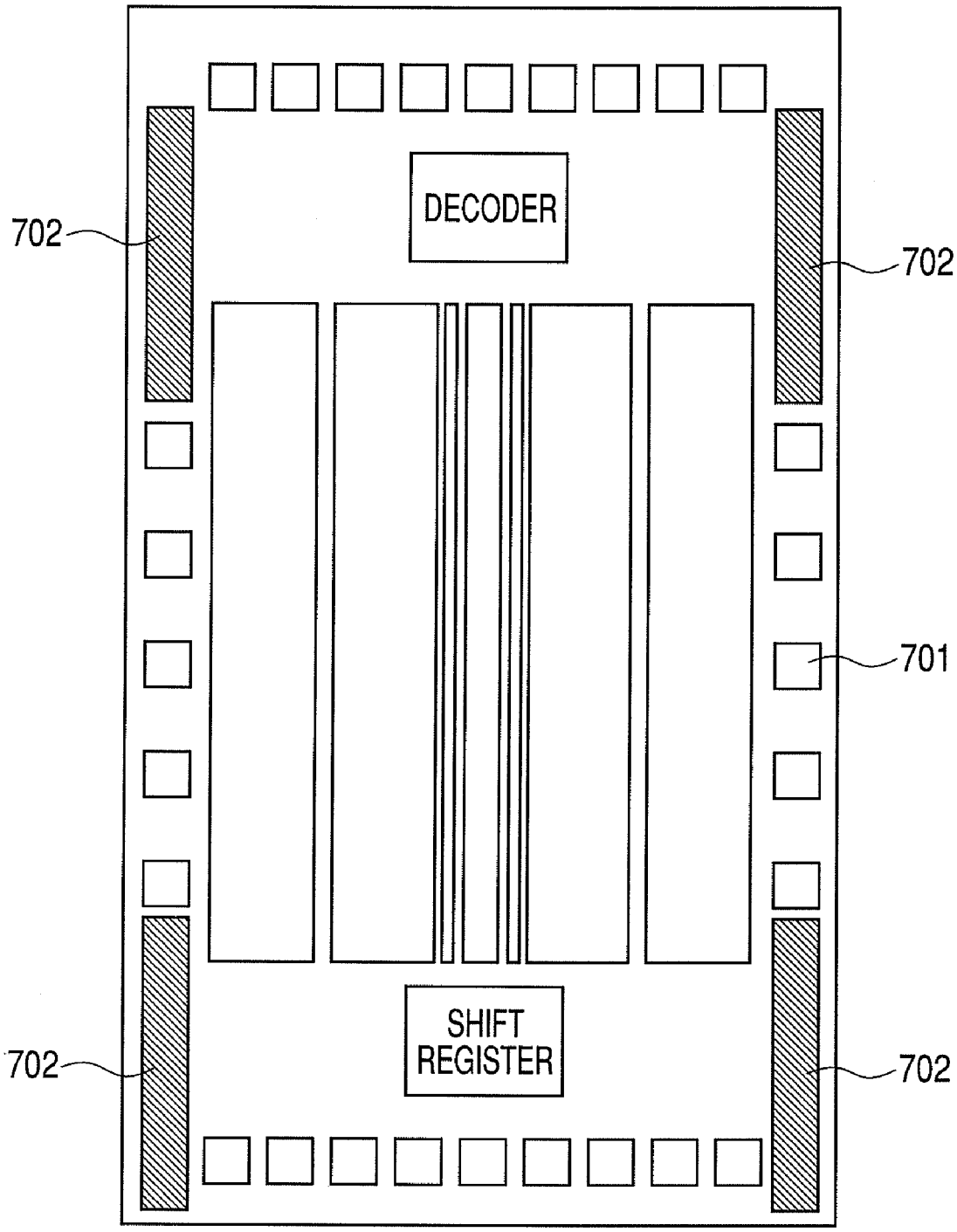
FIG. 11 is a schematic view illustrating still another conventional ink jet recording head substrate.

In addition, a plurality of connection pads 105 is formed on the substrate 100 as first electrical connection terminals (first terminals) arranged along a substrate shorter side which is a first side extending in a cross direction intersecting the longitudinal direction of the ink supply port 106 (in this embodiment, intersecting at right angles). Furthermore, a heater driving power source connection pad 101 and a ground connection pad 102 are formed on the substrate 100 as second electrical connection terminals (second terminals) arranged along a substrate longer side which is a second side extending in the longitudinal direction of the ink supply port 106. The connection pads 101 and 102 are situated in an area between the first side (substrate shorter side) of the substrate 100 and a phantom line that passes through a longitudinal end of the ink supply port 106 and extends in the cross direction. The heater driving power source wiring 103 is connected to the heater driving power source connection pad 101, and the ground wiring 104 is connected to the ground connection pad 102. Like the conventional structural example illustrated in FIG. 9, the arrangement of the wiring 103 and 104 and the pads 101 and 102 on the substrate 100 shows a symmetry between the upper and lower halves in the illustration.

The connection pads 101 and 102 are placed along the substrate longer side extending in the longitudinal direction of the substrate 100. In the example illustrated in FIG. 3, each of the connection pads 105 is shaped as a square whose side is 100 μm long, and each of the connection pads 101 and 102 is shaped as a rectangle of 200 μm×100 μm with its longer side lying in the same direction as the substrate longer side.

Figure 4:
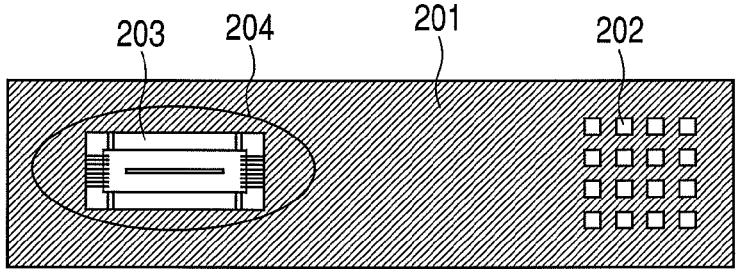
FIG. 4 is a view illustrating a state where an ink jet recording head substrate on which a nozzle for discharging a liquid droplet is formed is mounted on TAB tape.

FIG. 4 illustrates a state where an ink jet recording head substrate 203 in which a nozzle for discharging a liquid droplet is formed is mounted on TAB tape 201. A plurality of contact pads 202 for electrical connection with an ink jet recording apparatus main body is provided in the vicinity of one end of the TAB tape 201, and the substrate 203 is connected via inner leads in the vicinity of an opposite end of the TAB tape 201.

Figure 5:
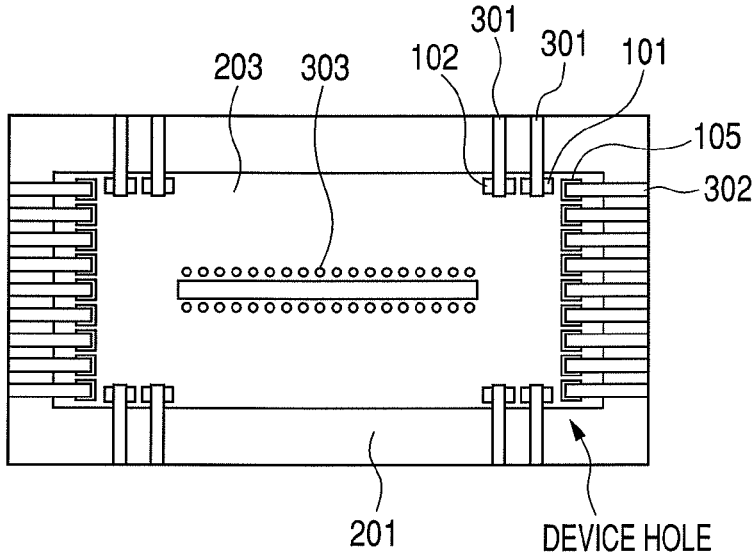
FIG. 5 is an enlarged view of a part designated by sign 204 in FIG. 4.

FIG. 5 is an enlarged view of a part designated by sign 204 in FIG. 4. Inner leads 301 and 302 protrude from edges of a device hole formed in the TAB tape 201. The inner leads 301 and 302 are electrically connected to the connection pads 101, 102, and 105 by gang bonding. Discharge ports 303 are used for discharging ink. Heaters are provided directly below the discharge ports in a one-to-one correspondence.

Figure 6:
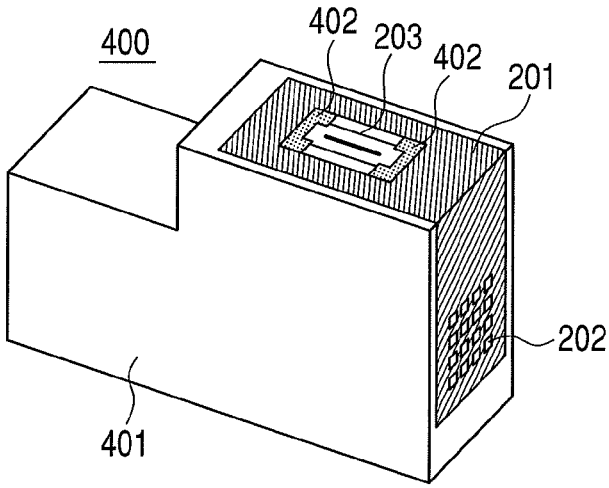
FIG. 6 is a perspective view illustrating a completed ink jet recording head.
Figure 7:
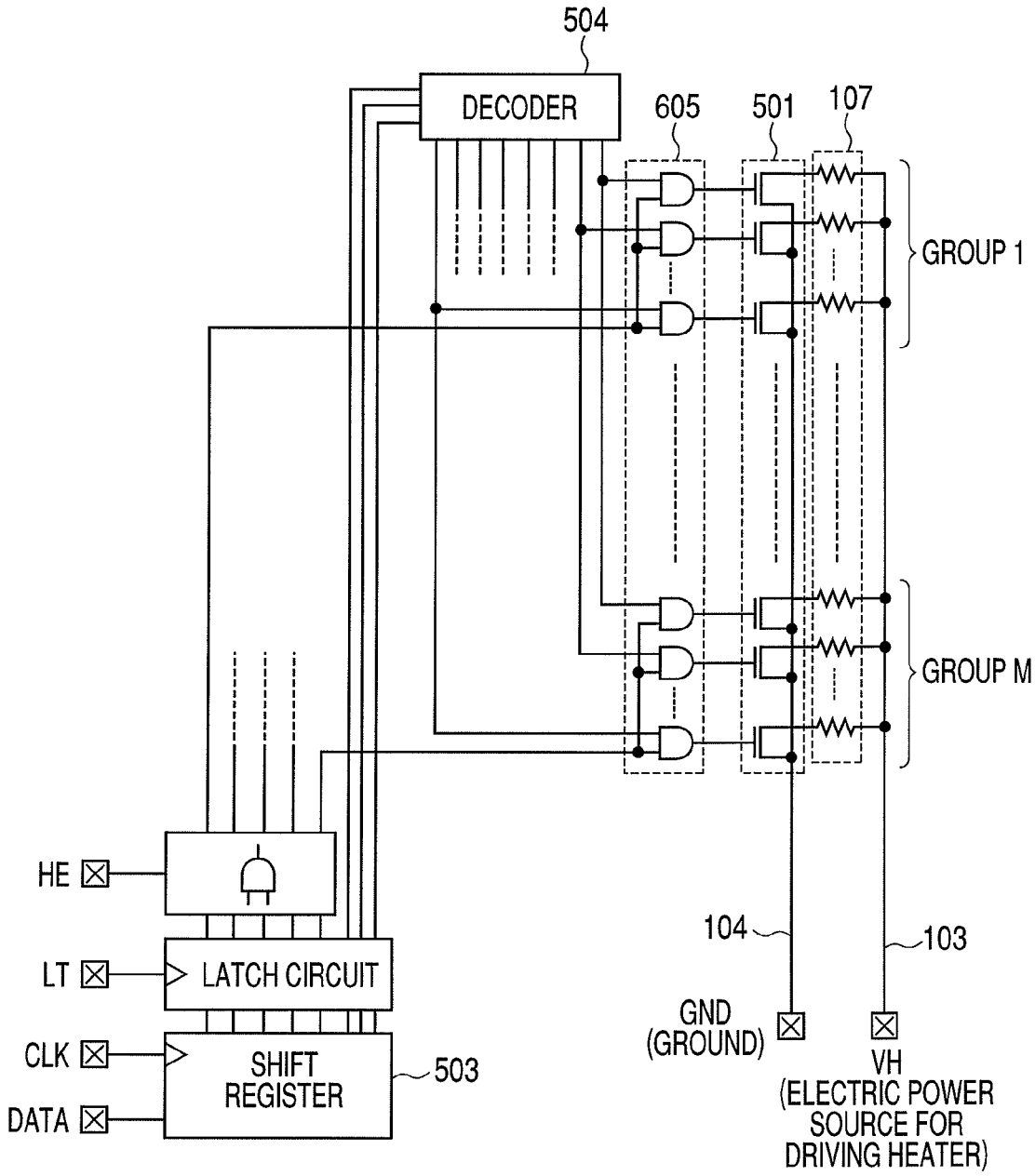
FIG. 7 is a representative circuit block diagram of an ink jet recording head substrate according to the present invention.
Figure 8:
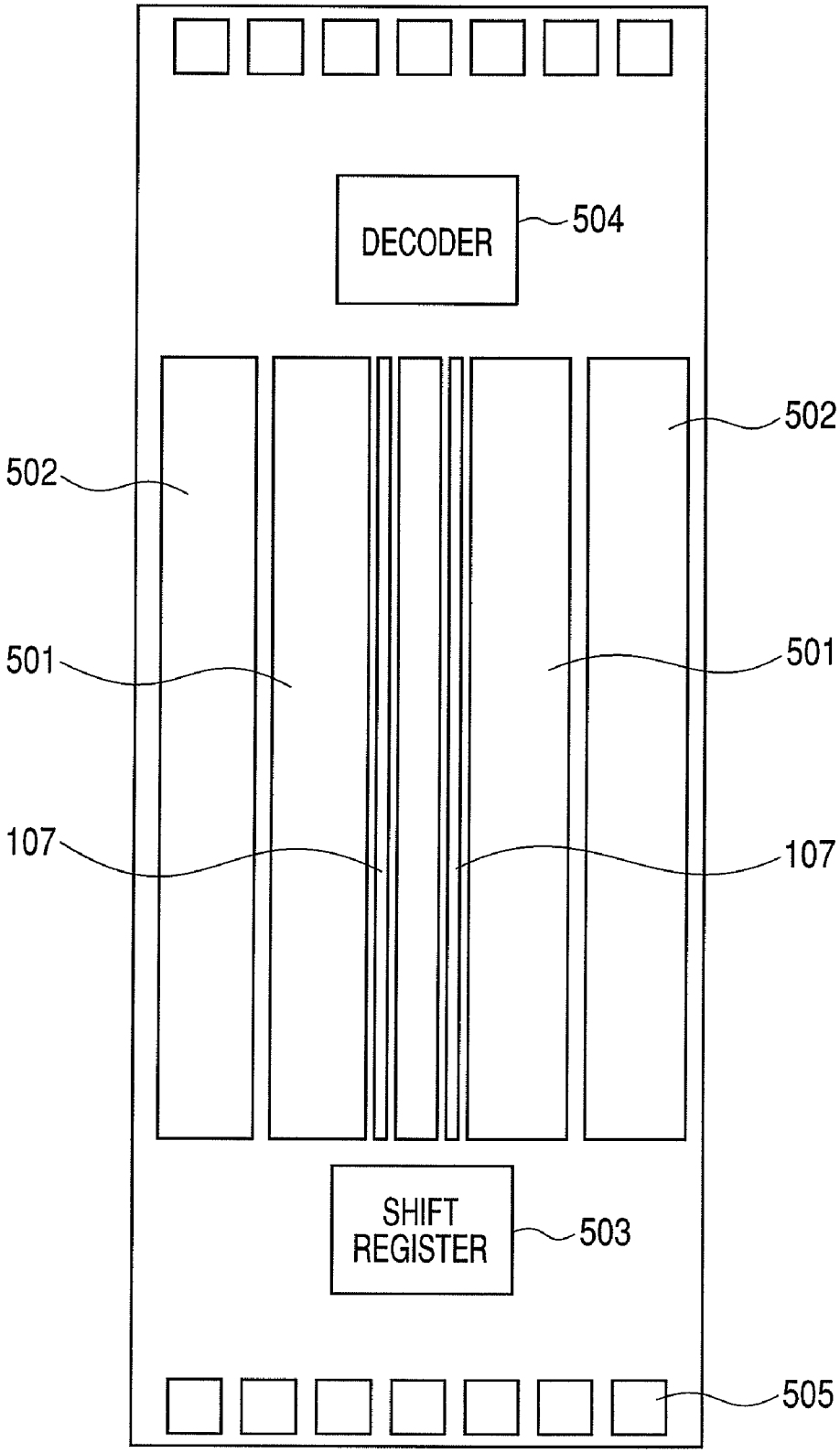
FIG. 8 is a schematic view illustrating a conventional ink jet recording head substrate.

FIG. 6 is a perspective view illustrating a completed ink jet recording head. The TAB tape 201 illustrated in FIG. 4 is joined to a wall surface of an ink tank 401, and the inner lead part of the TAB tape 201 is sealed by a sealant 402. Further, the TAB tape 201 is bent along the wall surface of the ink tank 401, and the part where the contact pads 202 are disposed is fixed to the wall surface of the ink tank 401 in tight contact. Though FIG. 6 illustrates a state where the substrate 203 faces upward, the substrate 203 faces downward when the recording head is installed into the ink jet recording apparatus. FIG. 7 is a representative circuit block diagram of an ink jet recording head substrate according to the present invention. The electric power source for driving heater (VH) 103 is connected to heaters, and the ground (GND) 104 is connected to drivers. Recording data and block control data are input in a DATA terminal. These data enter a shift register 503 in accordance with a clock from a CLK terminal, and are held in a latch circuit based on a latch signal from an LT terminal. A recording data signal is subject to an AND operation with a heat enable signal from an HE terminal, and is input for each heater group. A block control data signal is decoded by a decoder 504, and input in each segment in each heater group. The recording data signal and the block control data signal are input in an AND circuit 605, and drivers are turned ON to cause currents to flow into heaters.

Referring to FIG. 3 again, the four connection pads 101 and 102 to which the wiring 103 and 104 of the power source system are connected are placed on the substrate longer side at each longitudinal end of the substrate. As a result, the number of connection pads 105 that are placeable on the substrate shorter side can be increased by the spaces conventionally occupied by the four connection pads 101 and 102. Hence logic terminals that need to be added for enhanced functionality of the recording head can be placed in these empty spaces.

Moreover, each of the connection pads 101 and 102 has a rectangular shape which is longer in the longitudinal direction of the substrate as mentioned above, so that the part of connection with the wiring 103 or 104 can be widened when compared with the connection pads 105 on the substrate shorter side. Since the connection pads 105 are provided on the substrate shorter side with high density, the width of each of the connection pads 105 cannot be increased. On the other hand, the space limitation is less strict on the substrate longer side, and accordingly the width of each of the connection pads 101 and 102 placed on the substrate longer side can be freely set when compared with the connection pads 105. Furthermore, by placing the connection pads 101 and 102 on the substrate longer side in the above-mentioned manner, it is possible to reduce a wiring distance of the ground wiring 104, which is at an outermost position of the substrate 100, to the connection pad 102. These structures contribute to a lower wiring resistance of a power source line, and thus a waste of power consumption can be avoided.

Note that the wiping operation to the substrate 100 is performed in such a way that moves a blade (not illustrated), which has an approximately same width as a length of the ink supply port 106 in the longitudinal direction, in a direction along the substrate shorter side so as to wipe the entire ink supply port 106. In view of such a wiping operation, in this embodiment the connection pads 101 and 102 are formed in the area between the substrate shorter side at each longitudinal end of the substrate 100 and the corresponding longitudinal end of the ink supply port 106 in the longitudinal direction of the substrate 100, as described earlier. This keeps the connection pads 101 and 102 from interfering with the wiping operation, and prevents the liquid such as ink wiped by the wiping operation from adhering to the connection pads 101 and 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-136495, filed May 26, 2008, hereby incorporated by reference herein its entirety.

What is claimed is:

1. An ink jet recording head substrate provided with: an array of a plurality of energy generating bodies for generating energy utilized to discharge ink; and an ink supply port arranged along the array to supply ink to the plurality of energy generating bodies, the array and the ink supply port each extending in a longitudinal direction of the ink jet recording head substrate, the ink jet recording head substrate comprising:

a first terminal electrically connected with the plurality of energy generating bodies, the first terminal being arranged along beside a first side of the ink jet recording head substrate, the first side extending in a cross direction intersecting the longitudinal direction; and a second terminal electrically connected with the plurality of energy generating bodies, the second terminal being arranged beside a second side of the ink jet recording head substrate, the second side extending in the longitudinal direction, so as to be arranged in an area between the first terminal and a phantom line that passes through a longitudinal end of the ink supply port closer to the first side and extends in the cross direction.

2. The ink jet recording head substrate according to claim 1, wherein a width of the second terminal in the longitudinal direction is larger than a width of the first terminal in the longitudinal direction, and larger than a width of the first terminal in the cross direction.

3. The ink jet recording head substrate according to claim 2, wherein the second terminal has a rectangular shape that is longer in the longitudinal direction.

4. The ink jet recording head substrate according to claim 1, provided with power source wiring and ground wiring for supplying driving power to the plurality of energy generating bodies, wherein one of the power source wiring and the ground wiring is connected to the second terminal.

5. An ink jet recording head comprising the ink jet recording head substrate according to claim 1, and a plurality of ink discharge ports provided correspondingly to the plurality of energy generating bodies, respectively.

* * * * *